US009441617B2

(12) United States Patent
Kazumasa

(10) Patent No.: US 9,441,617 B2
(45) Date of Patent: Sep. 13, 2016

(54) LIQUID DELIVERY METHOD AND APPARATUS

(75) Inventor: Ikushima Kazumasa, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 2378 days.

(21) Appl. No.: 11/814,224

(22) PCT Filed: Jan. 18, 2006

(86) PCT No.: PCT/JP2006/300626
§ 371 (c)(1),
(2), (4) Date: Aug. 26, 2008

(87) PCT Pub. No.: WO2006/085433
PCT Pub. Date: Aug. 17, 2006

(65) Prior Publication Data

US 2009/0071974 A1 Mar. 19, 2009

(30) Foreign Application Priority Data

Jan. 18, 2005 (JP) ..... 2005-010331

(51) Int. Cl.
*G01F 11/00* (2006.01)
*F04B 7/00* (2006.01)
*F04B 9/105* (2006.01)

(52) U.S. Cl.
CPC ..... *F04B 7/0007* (2013.01); *F04B 9/105* (2013.01)

(58) Field of Classification Search
CPC ..... F04B 9/105; F04B 7/0007
USPC ..... 222/1, 218, 282, 291, 305, 306, 309, 222/344, 361–363, 333, 334, 366, 380, 319
See application file for complete search history.

(56) References Cited

U.S. PATENT DOCUMENTS 1,815,875 A * 7/1931 Muller ..... 222/205
3,227,325 A * 1/1966 Bates ..... 222/309

(Continued)

FOREIGN PATENT DOCUMENTS

JP 43-6644 B 3/1968
JP 43-6644 B1 3/1968

(Continued)

OTHER PUBLICATIONS

International Search Report of PCT/JP2006/300626, date of mailing Jun. 20, 2006.

(Continued)

*Primary Examiner* — J. Casimer Jacyna
(74) *Attorney, Agent, or Firm* — Westerman, Hattori, Daniels & Adrian, LLP

(57) ABSTRACT

A liquid delivery method and apparatus which can suppress generation of turbulent flows and air bubbles, In the liquid delivery method and apparatus for delivering a liquid by reciprocally moving a plunger in a cylinder while a selector valve is shifted in a valve chamber to change over communication of the cylinder and the valve chamber with a channel leading to a liquid tank and communication of the cylinder and the valve chamber with a channel leading to a delivery port from one to the other, the cylinder and the valve chamber are communicated with the channel leading to the liquid tank and an opening/closing valve disposed between that channel and the liquid tank is opened when the plunger is retracted, and the cylinder and the valve chamber are communicated with the channel leading to the delivery port and the opening/closing valve is closed when the plunger is advanced.

14 Claims, 6 Drawing Sheets

(56) References Cited

U.S. PATENT DOCUMENTS

| | | | | |
|---|---|---|---|---|
| 3,250,441 | A * | 5/1966 | Levowitz et al. | 222/309 |
| 4,730,648 | A * | 3/1988 | Walter | 141/91 |
| 4,793,524 | A * | 12/1988 | Starr | 222/309 |
| 4,819,833 | A * | 4/1989 | Huddleston et al. | 222/155 |
| 5,718,354 | A * | 2/1998 | Binley | 222/1 |
| 7,357,280 | B2 * | 4/2008 | Nishinomiya et al. | 222/252 |

FOREIGN PATENT DOCUMENTS

| | | | |
|---|---|---|---|
| JP | 60-19970 | A | 7/1983 |
| JP | 58-178888 | A | 10/1983 |
| JP | 60-6083 | A | 1/1985 |
| JP | 64-37271 | A | 2/1989 |
| JP | 2000-334355 | A | 12/2000 |

OTHER PUBLICATIONS

International Preliminary Report on Patentability dated Jan. 24, 2008, issued in corresponding PCT/JP2006/300626.

* cited by examiner (a)

(b)

(a)

(b)

(a)

(b)

LIQUID DELIVERY METHOD AND APPARATUS

TECHNICAL FIELD

The present invention relates to a liquid delivery method and apparatus for delivering a liquid by reciprocally moving a plunger in a cylinder. More particularly, the present invention is intended to, in such a liquid delivery method and apparatus, to suppress generation of air bubbles and chips and to satisfactorily deliver a liquid, particularly a low-viscous liquid, in desired amount while keeping the liquid in a clean state.

BACKGROUND ART

In one example of known liquid delivery apparatuses, a cylinder containing a plunger inserted therein in a reciprocally movable manner is communicated with a suction valve and a discharge valve. In that type of apparatus, when the plunger is reciprocally moved, the suction valve is opened and a liquid is supplied to the cylinder in a retraction stroke of the plunger, while the discharge valve is opened and the liquid is discharged from the cylinder in an advance stroke of the plunger, whereby the liquid is delivered from a nozzle communicated with the discharge valve (Patent Document 1).

In another example of known liquid delivery apparatuses, a suction port and a discharge port are selectively communicated with a cylinder containing a plunger inserted therein by a selector valve, which has a valve member rotated in a valve chamber, such that the communication between the suction port and the cylinder and the communication between the discharge port and the cylinder are changed over from one to the other (Patent Document 2).

Patent Document 1: Japanese Patent Laid-Open No. 58-178888

Patent Document 2: Japanese Patent Laid-Open No. 60-19970

DISCLOSURE OF THE INVENTION

Problems to be Solved by the Invention

The apparatus of Patent Document 1 accompanies with the problem that, when the liquid passes through a complicated channel within the discharge valve, a turbulent flow is generated to disturb the delivery of the liquid, or many air bubbles are generated due to cavitation, etc. and delivered through the nozzle.

In the apparatus of Patent Document 2, if a gap between the valve member and the valve chamber of the selector valve is too tight, the selector valve cannot smoothly slide. In the worst case, the selector valve may be twisted and damaged, or the selector valve or the valve chamber may be worn, thus resulting in the problem that chips are mixed in the liquid and delivered together with the liquid, or come into the gap between the valve member and the valve chamber to impede smooth sliding of the selector valve.

Further, if the gap between the valve member and the valve chamber is set to be loose, the liquid in the suction port may flow through the gap between the valve member and the valve chamber and may be delivered through the nozzle regardless of the reciprocal movement of the plunger. Such an undesired phenomenon is apt to occur when a low-viscous liquid is used. Particularly, that phenomenon is more apt to occur when the liquid in the suction port side is pressurized for the purpose of enabling the liquid to be more easily supplied to the cylinder.

In view of the above-mentioned problems in the art, an object of the present invention is to provide, in a liquid delivery apparatus for delivering a liquid by reciprocally moving a plunger in a cylinder, a liquid delivery method and apparatus which can suppress generation of turbulent flows and air bubbles, can prevent the liquid from flowing unintentionally from a suction port to a discharge port, can avoid generation of chips, are hard to damage, and can satisfactorily deliver the liquid.

Means for Solving the Problems

The method and apparatus to solve the above-mentioned problems are based on ideas set forth below as solving means.

According to a first solving means, the present invention provides a liquid delivery apparatus comprising a valve chamber having a first port, a second port and a third port, a selector valve having a valve member moved in the valve chamber to change over communication between the first port and the second port and communication between the first port and the third port from one to the other, a cylinder communicating with the first port and containing a plunger inserted therein, an opening/closing valve communicating with the second port, and a liquid delivery port communicating with the third port.

With such a structure, the opening/closing valve is connected to liquid storing means or liquid supply means, and the selector valve is changed over by moving the valve member so as to communicate the first port with the second port. Then, the opening/closing valve is opened to communicate the liquid storing means or the like and the second port with each other, and the plunger is withdrawn in a direction away from the valve chamber through a distance corresponding to an amount of the liquid to be delivered, whereby the liquid is filled in the cylinder via the opening/closing valve, the second port, and the selector valve. Then, the opening/closing valve is closed and the selector valve is changed over by moving the valve member so as to communicate the first port with the third port. By pushing the plunger in a direction toward the valve chamber thereafter, the liquid in the cylinder is delivered via the selector valve, the third port, and the liquid delivery port. At that time, because of no provision of the opening/closing valve on the delivery port side, generation of air bubbles is suppressed and the liquid can be satisfactorily delivered.

In addition, the opening/closing valve is closed other than a period during which the liquid is filled in the cylinder. Therefore, even when sliding contact between the valve chamber and the valve member of the selector valve is set relatively loose, the liquid is prevented from passing through a gap between the valve chamber and the valve member and from being delivered through the liquid delivery port 17. As a result, the sliding contact between the valve chamber and the valve member of the selector valve can be set relatively loose.

Also, according to the first solving means, in a liquid delivery method for delivering a liquid by reciprocally moving a plunger in a cylinder while a selector valve is shifted in a valve chamber to change over communication of the cylinder and the valve chamber with a channel leading to a liquid tank and communication of the cylinder and the valve chamber with a channel leading to a delivery port from one to the other, the method comprises the steps of communicating the cylinder and the valve chamber with the channel leading to the liquid tank and opening an opening/closing valve disposed between that channel and the liquid tank when the plunger is retracted, and communicating the cylinder and the valve chamber with the channel leading to the delivery port and closing the opening/closing valve when the plunger is advanced.

Stated another way, by moving the selector valve in the valve chamber, the communication of the cylinder and the valve chamber with the channel leading to the liquid tank and the communication of the cylinder and the valve chamber with the channel leading to the delivery port is changed over from one to the other. On that occasion, when the plunger is retracted, the cylinder and the valve chamber are communicated with the channel leading to the liquid tank, and the opening/closing valve disposed between that channel and the liquid tank is opened. When the plunger is advanced, the cylinder and the valve chamber are communicated with the channel leading to the delivery port, and the opening/-closing valve is closed to cut off the communication of the cylinder and the valve chamber with the channel leading to the liquid tank.

According to a second solving means, the liquid delivery apparatus is featured in that the opening/closing valve is a check valve disposed in such an orientation that the liquid is allowed to flow from the exterior to the second port, but the liquid flow in the reversed direction is blocked.

With that arrangement, when the plunger is retracted while the selector valve is shifted so as to communicate the first port and the second port with each other, the pressure in the cylinder is lowered, whereupon the check valve is opened and the liquid is filled in the cylinder. By constituting the opening/closing valve as the check valve, therefore, the opening/closing valve can be opened in response to the retraction of the plunger without requiring special opening/closing control.

Also, the liquid delivery method is featured in that the opening/closing valve is automatically opened and closed by employing a check valve disposed in such orientation that the liquid is allowed to flow from the liquid tank to the valve chamber, but the liquid flow from the valve chamber to the liquid tank is blocked.

According to a third solving means, the liquid delivery apparatus is featured in that the selector valve is moved while sliding along an inner wall surface of the valve chamber without coming into tight contact with the inner wall surface of the valve chamber or without causing excessive friction.

With that arrangement, it is possible to avoid the valve chamber or the valve member from being damaged due to an excessive force imposed on it, and to prevent chips from being generated due to friction between the valve chamber and the valve member.

Also, the liquid delivery method is featured in that the selector valve is moved while sliding along an inner wall surface of the valve chamber without coming into tight contact with the inner wall surface of the valve chamber or without causing excessive friction.

According to a fourth solving means, the liquid delivery apparatus is featured in that the selector valve is a selector valve changing over its shift position with rotation of the valve member and has a first opening formed to position on an axis of rotation of the valve member.

With that arrangement, the amount of the liquid in the valve chamber can be minimized and the influence of reaction of the liquid can also be minimized. Therefore, channels can be smoothly changed over at a high speed.

Also, the liquid delivery method is featured in that the selector valve is moved by rotating, in the valve chamber, a selector valve having a first opening formed to position on an axis of valve rotation and a second opening communicated with the first opening.

According to a fifth solving means, the liquid delivery apparatus is featured in that the cylinder is arranged at a lower position than the first port with a fore end of the plunger directed upward.

With no provision of the opening/closing valve on the delivery port side, the generation of air bubbles can be suppressed. Nevertheless, a small number of air bubbles may be unintentionally generated in some cases. Even in such a case, since the fore end of the plunger is directed upward, the air bubbles lighter than the liquid are forced to flow upward, pass through the first port, and flow toward the delivery port through the third port, followed by being discharged. As a result, the air bubbles are prevented from being accumulated in the cylinder, and the liquid can be always delivered in the desired amount. Further, since the air bubbles are discharged promptly while their sizes are still small, work for purging out the air bubbles by stopping the operation of the apparatus is not required.

Also, the liquid delivery method is featured in that the cylinder is arranged with a fore end of the plunger directed upward.

Advantages of the Invention

According to the present invention, since the liquid does not flow through a component having a complicated structure, such as a discharge valve, it is possible to avoid such a risk that a turbulent flow is caused to disturb the delivery of the liquid, or a large number of air bubbles are generated due to, e.g., cavitation and delivered through a nozzle. As a result, the liquid can be satisfactorily delivered.

Since the sliding contact between the valve chamber and the valve member of the selector valve can be set relatively loose, it is possible to avoid such a risk that the valve chamber or the valve member can be avoided from being damaged due to an excessive force imposed on it, and the friction between the valve chamber or the valve member generates chips which are mixed in the liquid.

Also, with the opening/closing valve constituted as the check valve, the opening/closing valve can be opened in response to the retraction of the plunger without requiring special opening/closing control.

Further, since the air bubbles are prevented from being accumulated in the cylinder, the liquid can be always delivered in the desired amount. In addition, since the air bubbles are discharged promptly while their sizes are still small, work for purging out the air bubbles by stopping the operation of the apparatus is not required.

REFERENCE NUMERALS

Figure 1:
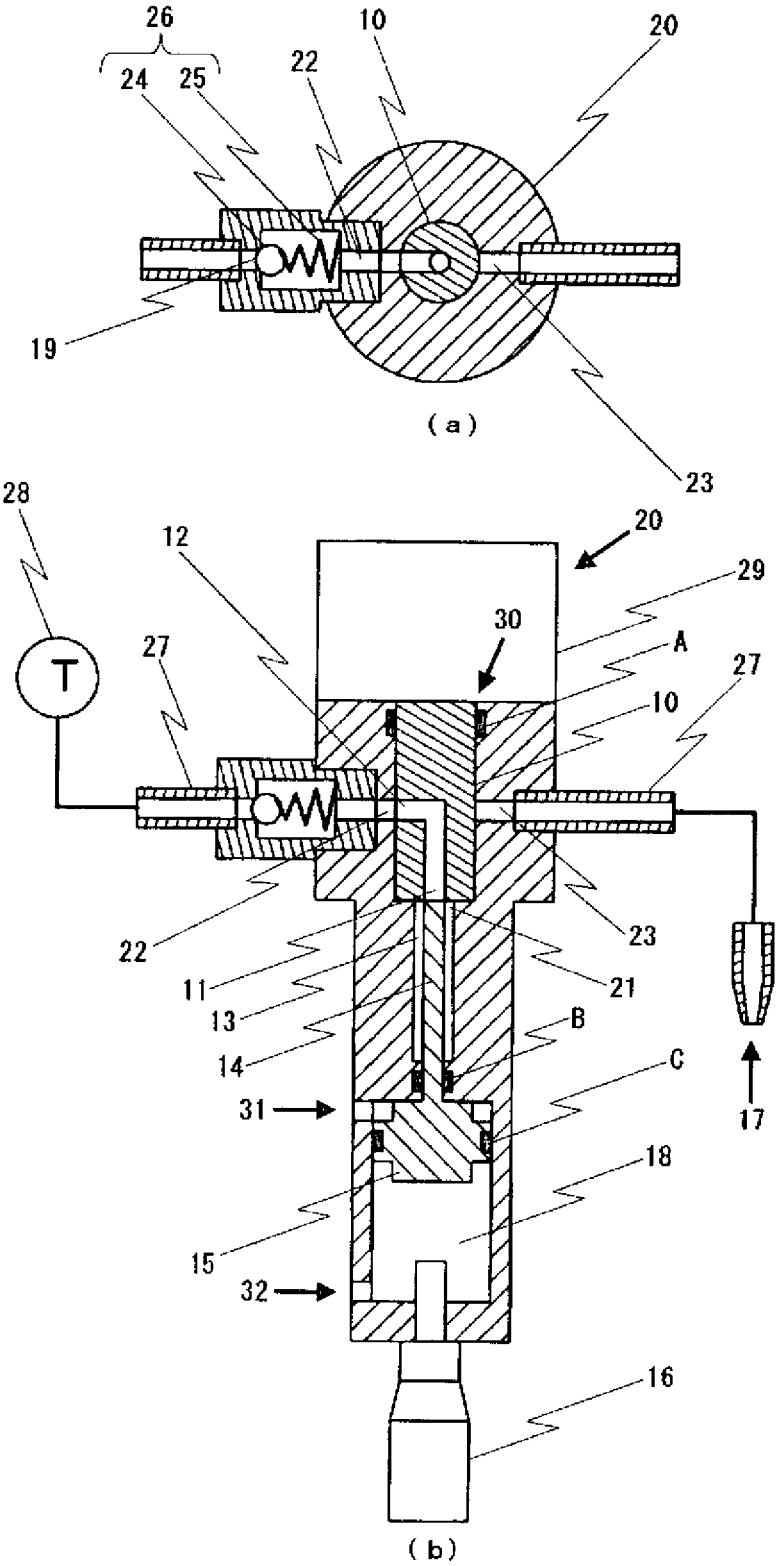
FIGS. 1(*a*) and 1(*b*) are respectively a plan sectional view and a side sectional view of an apparatus of the present invention in an initial state.

10: selector valve
11: first opening
12: second opening
13: cylinder
14: plunger
15: piston
16: stroke adjusting screw
17: delivery port
18: piston cylinder chamber
19: valve seat
20: main body
21: first port
22: second port
23: third port
24: ball valve member
25: spring
26: check valve
27: liquid feed tube
28: liquid tank
29: rotating actuator
30: valve chamber
31: first air opening
32: second air opening
51: slide valve
52: ball screw
53: motor
A, B, C: seal

BEST MODE FOR CARRYING OUT THE INVENTION

The best mode for carrying out the present invention will be described below with reference to the drawings.

As shown in FIG. 1, a liquid delivery apparatus of the present invention mainly comprises a main body 20, a valve chamber 30 formed as a columnar hole inside the main body 20, and a selector valve 10 rotatably inserted in the valve chamber 30.

The selector valve 10 has a first opening 11 formed in a bottom surface at one end thereof with its center positioned on an axis and a second opening 12 formed in a side surface thereof. The first opening 11 and the second opening 12 are communicated with each other via an L-shaped channel. A seal A is circumferentially disposed in the valve chamber 30 at a position near its opening to provide sealing-off such that a liquid having entered a gap between the valve chamber 30 and the selector valve 10 is prevented from leaking to the exterior. A first port 21 is formed in the bottom surface of the valve chamber 30 at the center thereof and is communicated with a cylinder 13 formed as a columnar bore. The selector valve 10 is coupled to a rotary shaft of a rotating actuator 29 such that the selector valve 10 is rotatable to a desired angle.

Figure 5:
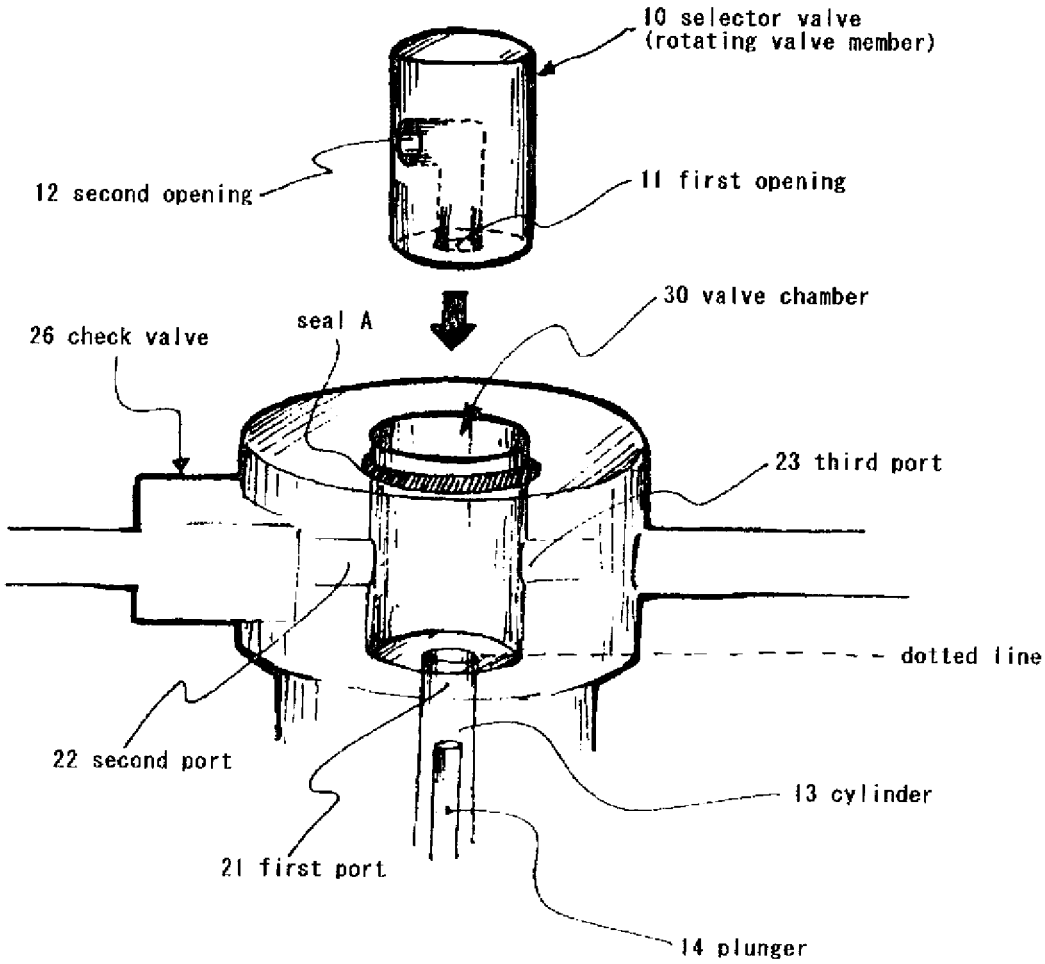
FIG. 5 is a perspective view for explaining a valve chamber, the view seeing through the valve to show the internal.

A second port 22 and a third port 23 are formed in opposite side walls of the valve chamber 30. When the selector valve 10 inserted in the valve chamber 30 is rotated, communication between the second opening 12 and the second port 22 and communication between the second opening 12 and the third port 23 are changed over from one to the other. As shown in FIG. 5, a cylindrical inner space positioned on the upper side of a dotted line α serves as the valve chamber 30, and a cylindrical inner space positioned on the lower side of the dotted line α serves as the cylinder 13.

A check valve 26 made up of a ball valve member 24 and a spring 25 is disposed in the second port 22, and the check valve 26 is communicated with a liquid tank 28 via a liquid feed tube 27. In the check valve 26, the ball valve member 24 is biased by the spring 25 to be pressed against a valve seat 19 disposed at an end closer to the liquid tank 28, thus allowing the liquid to flow from the liquid tank 28 to the second port 22, but blocking a flow of the liquid in a reversed direction.

The third port 23 is communicated with a liquid delivery port via another liquid feed tube 27.

A plunger 14 is inserted in the cylinder 13 with its fore end directed to the valve chamber 30. A rear end of the plunger 14 is coupled to a piston 15 reciprocally sliding in a piston cylinder chamber 18 which is formed in an innermost portion of the cylinder 13. A first air opening 31 and a second air opening 32 are formed in a side wall of the piston cylinder chamber 18 near at its opposite ends in vertically spaced relation. The plunger 14 can be reciprocally moved by adjusting air pressures supplied through those air openings. A seal B is circumferentially disposed between the cylinder 13 and the piston cylinder chamber 18 to provide sealing-off while allowing slide of the plunger 14, whereby the cylinder 13 and the piston cylinder chamber 18 are isolated from each other.

A seal C is disposed around an outer circumferential surface of the piston 15 in its portion sliding along an inner wall of the piston cylinder chamber 18 so that air in the first air opening 31 and air in the second air opening 32 are prevented from leaking from one side to the other side. A stroke adjusting screw 26 is disposed at a rear end of the piston cylinder chamber 18. The piston 15 is allowed to retract just until coming into contact with a fore end of the screw 16. By setting an amount of projection of the stroke adjusting screw 16, therefore, the stroke of the piston 15 and the plunger 14 coupled to the former is decided, whereby an amount of the delivered liquid can be set.

The apparatus constructed as described above operates as follows.

First, as shown in FIG. 1, the amount of projection of the stroke adjusting screw 16 is set in match with the desired amount of the delivered liquid. The selector valve 10 is rotated by manipulating the rotating actuator 29 to take a shift position where the second opening 12 of the selector valve 10 is communicated with the second port 22, namely the second opening 12 is located opposite to the second port 22. Air is introduced to the piston cylinder chamber 18 through the second air opening 32 while the first air opening 31 is opened, thus causing the plunger 14 to advance.

Figure 2:
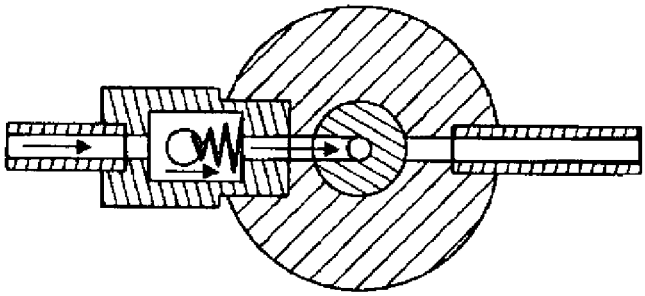
FIGS. 2(*a*) and 2(*b*) are respectively a plan sectional view and a side sectional view in a state where a piston is retracted.
Figure 2:
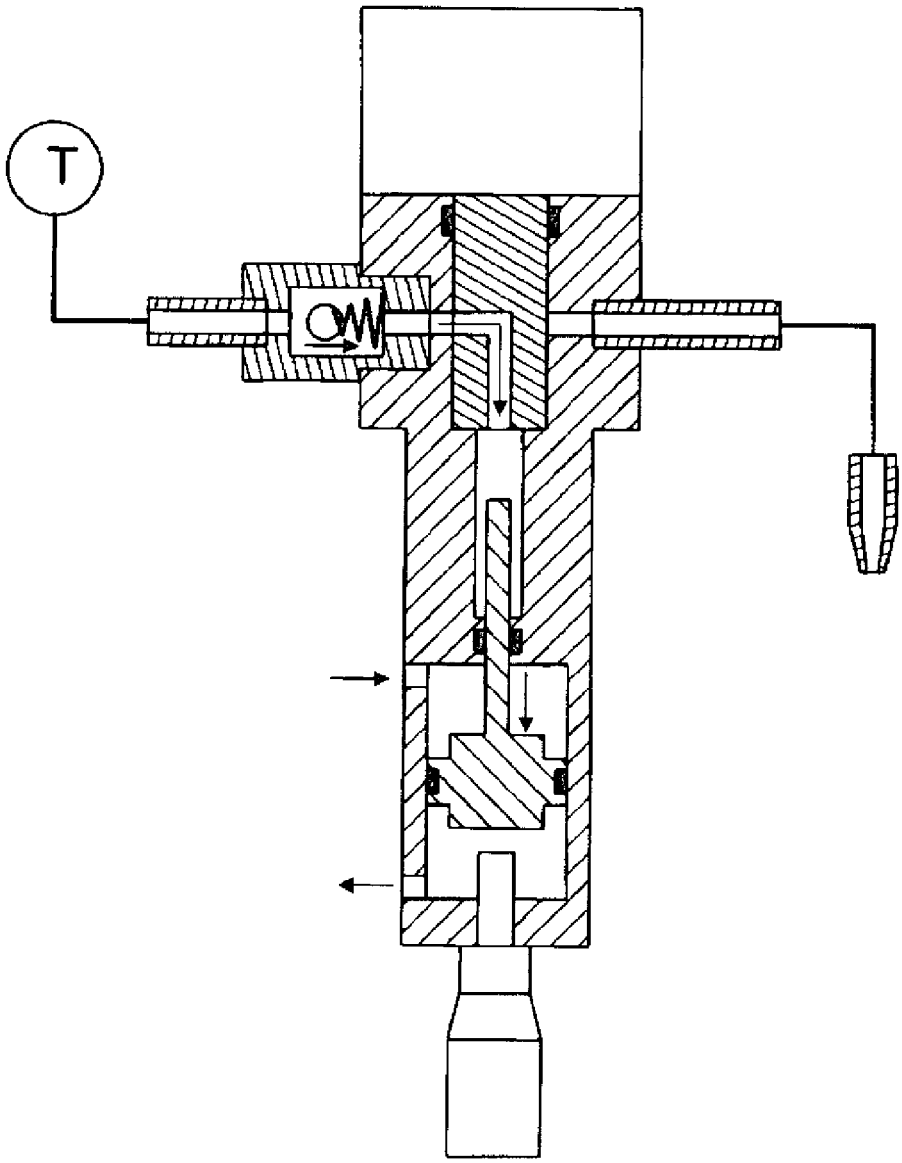

Then, as shown in FIG. 2, the air in the piston cylinder chamber 18 is discharged through the second air opening 32 and air is introduced to the piston cylinder chamber 18 through the first air opening 31 from the above-mentioned state. Responsively, the piston 15 is retracted until coming into contact with the fore end of the stroke adjusting screw 16. At the same time, the plunger 14 coupled to the piston 15 is also retracted, whereby the volume occupied by the plunger 14 in the cylinder 13 is reduced and the inner space volume of the cylinder 13 is increased correspondingly. In this state, the selector valve 10 is in the shift position where the second opening 12 is located opposite to the second port 22, namely the cylinder 13 is communicated with the second port 22, and the pressure in the cylinder 13 is lowered due to the increased space volume of the cylinder 13. Therefore, the ball valve member 24 in the check valve 26 disposed upstream of the second port 22 is moved away from the valve seat 19 while compressing the spring 25. As a result, the liquid flows from the liquid tank 28 to the second port 22 through the check valve 26, passes through the second opening 12 of the selector valve 10, and is then filled in the cylinder 13 via the first opening 11 and the first port 21.

Figure 3:
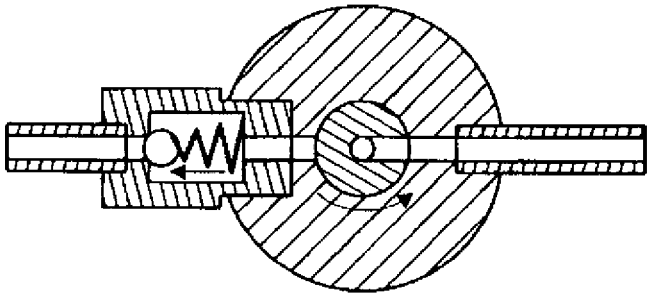
FIGS. 3(*a*) and 3(*b*) are respectively a plan sectional view and a side sectional view in a state where a valve member is rotated after the piston has been retracted.
Figure 3:
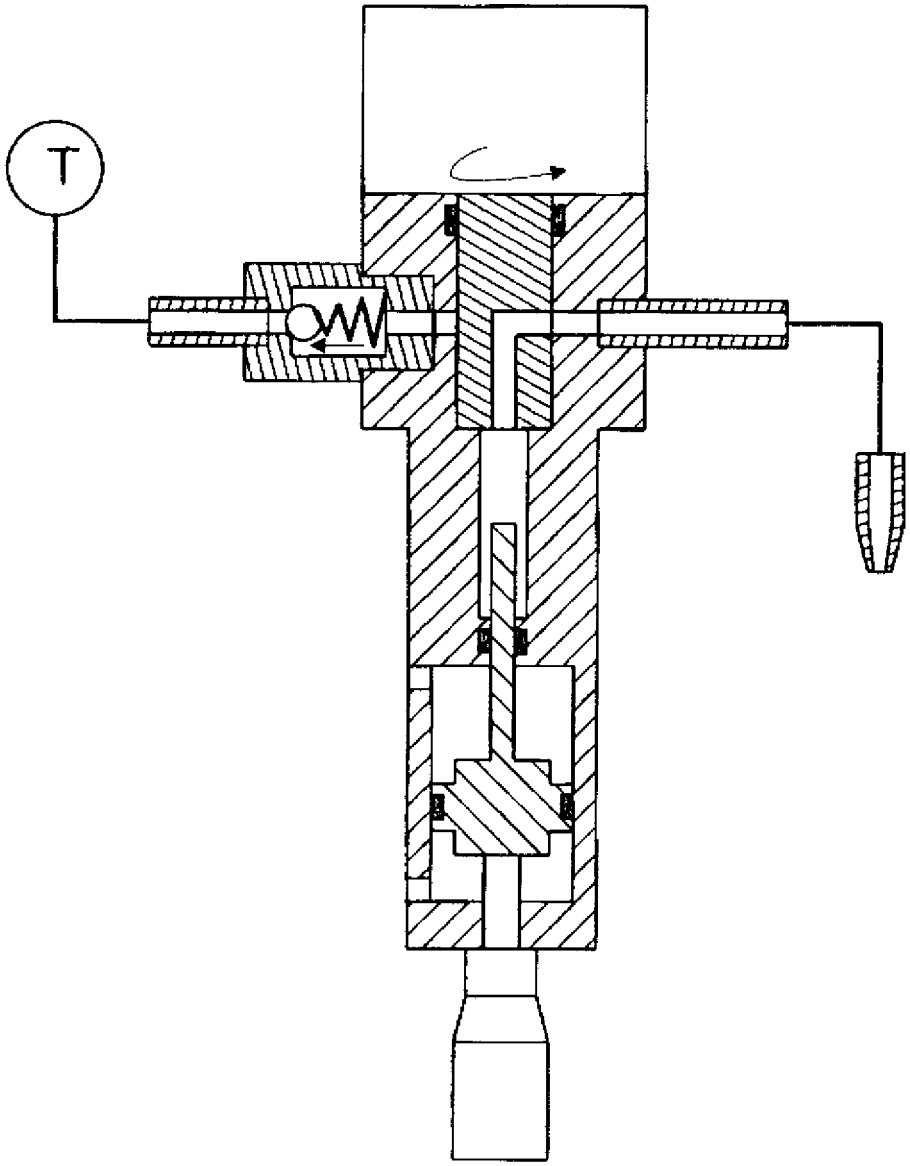

When the liquid is filled in the cylinder 13, the pressure lowered in the cylinder 13 is restored and a pressure difference of the liquid across the check valve 26 is reduced, whereby the ball valve member 24 is pressed against the valve seat 19 again with the biasing action of the spring 25 and the check valve 26 is closed as shown in FIG. 3. Then, the selector valve 10 is rotated by manipulating the rotating actuator 29 to take a shift position where the second opening 12 of the selector valve 10 is communicated with the third port 23, namely the second opening 12 is located opposite to the third port 23.

Figure 4:
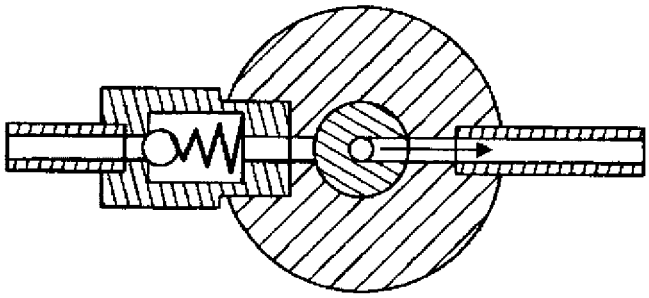
FIGS. 4(*a*) and 4(*b*) are respectively a plan sectional view and a side sectional view in a state where the piston is advanced after the selector valve has been rotated.
Figure 4:
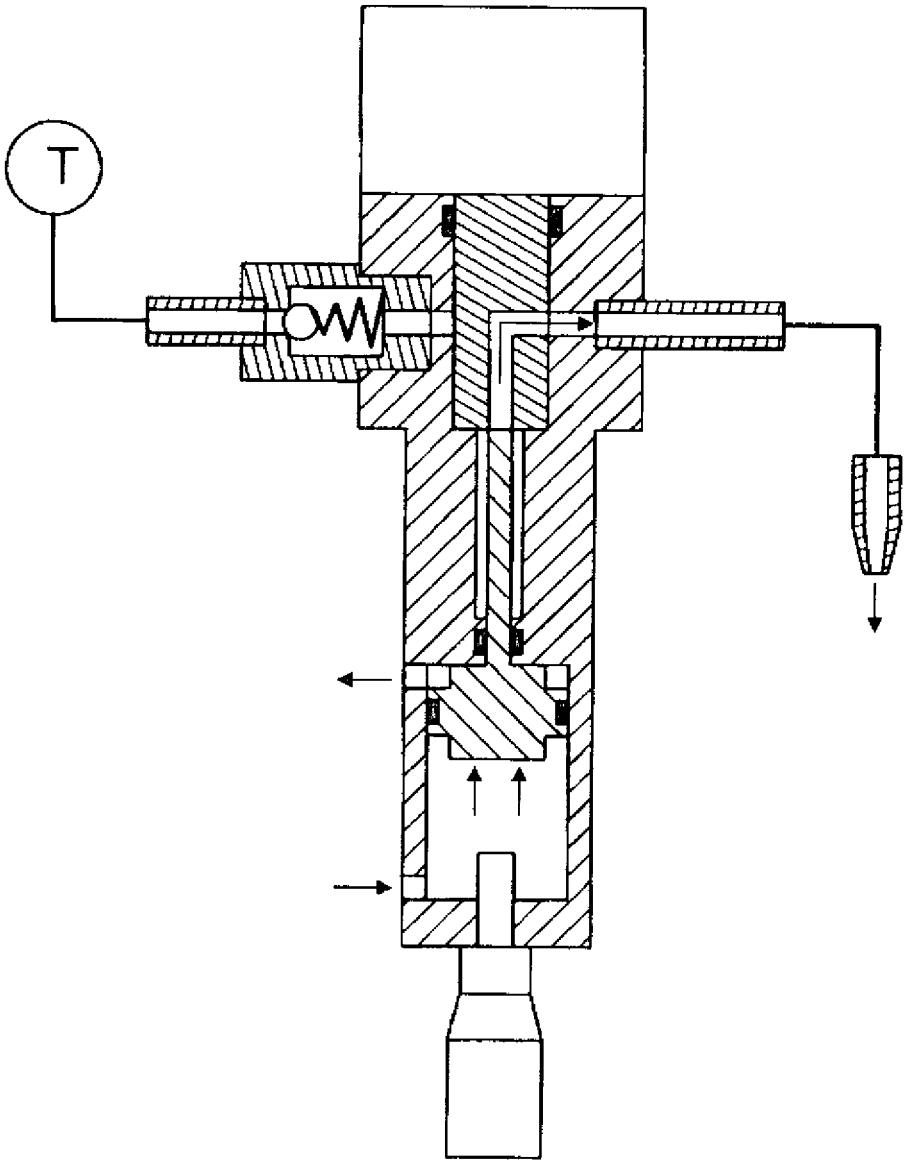

In that state, as shown in FIG. 4, the air in the piston cylinder chamber 18 is discharged through the first air opening 31 and air is introduced to the piston cylinder chamber 18 through the second air opening 32. Responsively, the piston 15 is advanced until coming into contact with an end wall of the piston cylinder chamber 18. At the same time, the plunger 14 coupled to the piston 15 is also advanced, whereby the volume occupied by the plunger 14 in the cylinder 13 is increased and the inner space volume of the cylinder 13 is reduced correspondingly. In this state, the selector valve 10 is in the shift position where the second opening 12 is located opposite to the third port 23, namely the cylinder 13 is communicated with the third port 23, and the inner space volume of the cylinder 13 is gradually reduced. Therefore, the liquid in the cylinder 13 is pushed out of it to flows through the first opening 11, the second opening 12 and the third port 23, and is then delivered through the delivery port 17.

In that way, one cycle of delivery operation is completed.

In the apparatus of the present invention, with the check valve 26 disposed on the liquid supply side, i.e., at the second port 22, even when the sliding contact between the selector valve 10 and the valve chamber 30 is set relatively loose, the liquid in the side of the liquid tank 28 is surely prevented from passing through the gap between the selector valve 10 and the valve chamber 30 and from being delivered through the delivery port 17 because the liquid in the side of the liquid tank 28 is blocked by the check valve 26. The liquid in the side of the liquid tank 28 is pressurized in some cases for the purpose of enabling the liquid to be more easily supplied, and the above feature is particularly effective in those cases.

Also, during the advance stroke of the plunger 14, because the check valve 26 cuts off the communication with the liquid supply side, the liquid in the cylinder 13 is surely prevented from passing through the gap between the selector valve 10 and the valve chamber 30 and from flowing back to the side of the liquid tank 28.

Thus, according to the apparatus of the present invention, the sliding contact between the selector valve 10 and the valve chamber 30 can be set relatively loose. Therefore, it is possible to avoid such a risk that the selector valve 10 and the valve chamber 30 are worn to generate chips which are mixed in the liquid and delivered through the delivery port 17, or which are caught between the selector valve 10 and the valve chamber 30 and impede the smooth sliding of the selector valve 10.

Further, by setting the sliding contact between the selector valve 10 and the valve chamber 30 to be relatively loose, the selector valve 10 can be smoothly rotated and therefore can be avoided from being damaged due to an excessive force imposed on the selector valve 10 upon twisting, etc.

No provision of the check valve on the side of the third port 23, i.e., at the port on the side of the delivery port 17, contributes to preventing the occurrence of turbulence in flow of the liquid and air bubbles due to cavitation, etc., which are otherwise caused with the provision of the check valve.

The apparatus of the present invention can be used in any posture with the rotating actuator 29 oriented upward, downward, leftward or rightward. However, the apparatus is preferably arranged such that the fore end of the plunger 14 is directed upward. With such a posture, even when air bubbles are unintentionally generated, the air bubbles are prevented from continuously residing in the cylinder 13. It is hence possible to avoid a risk that the amount of the liquid filled in the cylinder 13 is reduced with the presence of the air bubbles accumulated in the cylinder 13, and the amount of the delivered liquid is changed. As a result, the fixed amount of the delivered liquid can be always maintained steadily. In addition, because the generated air bubbles are discharged each time the plunger 14 is advanced, the operation of purging out the air bubble is not separately required and the work efficiency can be increased correspondingly, The rotating actuator 29 may be of any type employing air or a motor, for example, so long as it is able to rotate the selector valve 10 through a predetermined angle and change over the shift position of the selector valve 10 between the position where the second opening 12 is located opposite to the second port 22 and the position where the second opening 12 is located opposite to the third port 23.

The plunger 14 may contact with the inner wall of the cylinder 13 in tight relation or loose relation with a gap between them. The present of the gap makes the slide of the plunger 14 smoother and is effective in preventing the generation of chips due to friction between the plunger 14 and the cylinder 13.

While the angle between the second port 22 and the third port 23 is shown as being 180° in the drawings, it can be set to any other suitable angle, e.g., 90°. Leakage of the liquid and air can be more positively prevented by using seals, e.g., O-rings, to seal off joint portions and sliding portions between adjacent parts. Further, the liquid in the liquid tank 28 may be pressurized to promote the supply of the liquid so that the liquid can be more easily filled in the cylinder 13 when the plunger 14 is retracted.

The shape of the delivery port 17 is not limited to a particular one, and the number of the delivery port(s) 17 may be either plural or single. Those design items can be optionally selected depending on the purpose of the intended operation.

While the mechanism comprising the air cylinder and the piston is employed in the drawings to reciprocally move the plunger 14, any other suitable mechanism can also be employed so long as it is able to reciprocally move the plunger 14. For example, a mechanism using, e.g., a cam or a ball screw, is usable instead. In the case of employing the mechanism using a ball screw, the stroke of the plunger 14 can be set in accordance with the number of rotations of the ball screw, and setting with the adjusting screw or the like can be eliminated.

The check valve 26 is just required to be made open when the plunger 14 is retracted. Any other type of opening/closing valve can also be used so long as it has that function. For example, the check valve 26 may be a valve including a control mechanism for opening the valve in response to the retraction of the plunger 14.

Details of the present invention will be described below in connection with an embodiment, but the present invention is in no way limited to the following embodiment.

Embodiment 1

Figure 6:
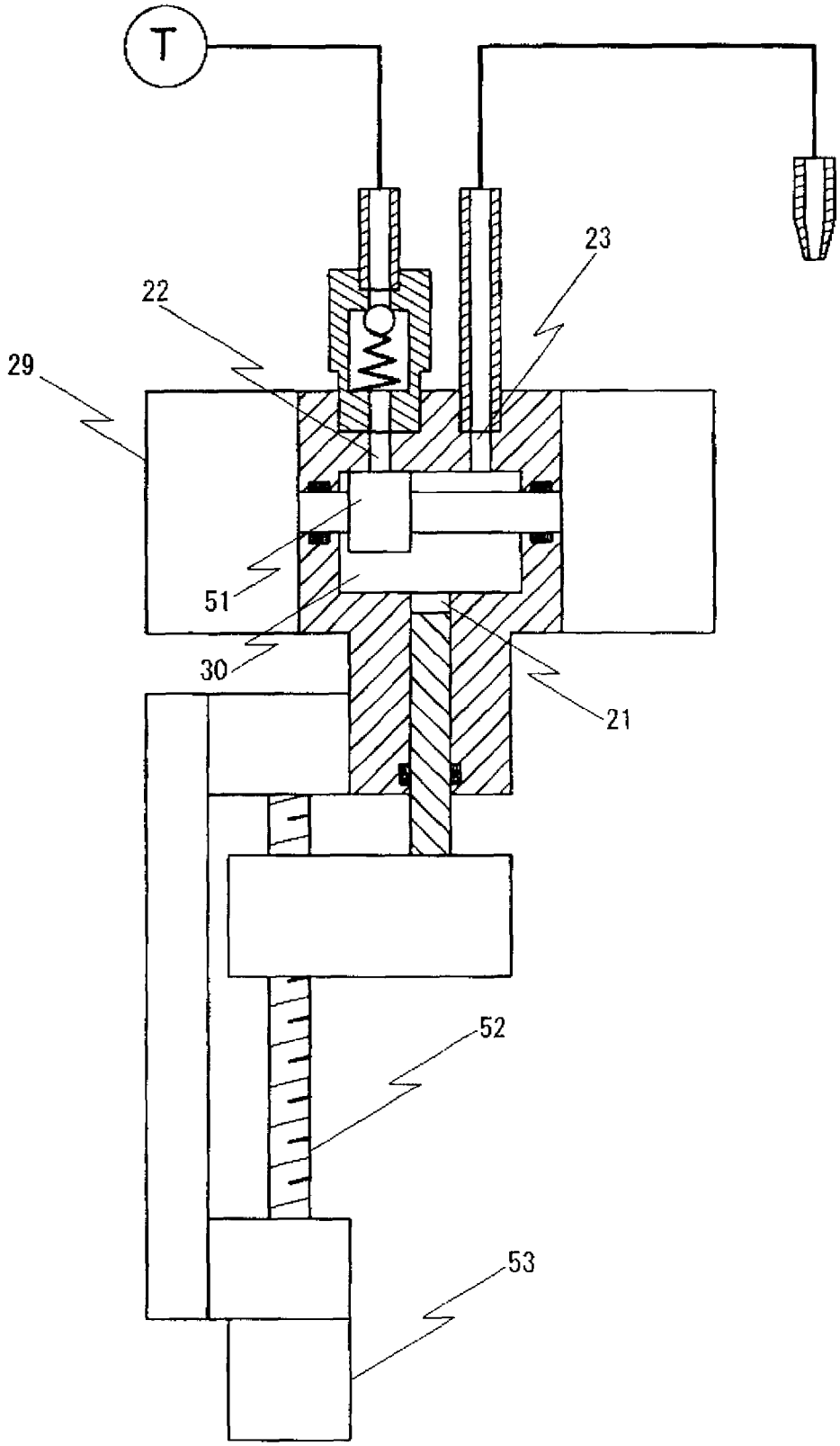
FIG. 6 is a side sectional view of an apparatus of Embodiment 1.

An apparatus of this embodiment has the same basic construction as that shown in FIGS. 1-4, but it differs from the above-described construction in that, as shown in FIG. 6, a slide valve 51 is used instead of the selector valve 10 and the driving means for reciprocally moving the plunger 14 is provided by a mechanism using a ball screw 52 instead of the mechanism using the piston 15. Also in this embodiment, since the check valve 26 is disposed at the second port 22 and is closed to prevent a backward flow of the liquid, the sliding contact between the slide valve 51 and the valve chamber 30 can be set relatively loose, and therefore similar advantages to those in the construction shown in FIGS. 1-4 can be obtained.

Further, since the plunger 14 can be reciprocally moved by a mechanism using the ball screw 52 which is rotated by a motor 53, the stroke of the plunger 14 can be set in accordance with the number of rotations of the motor 53. As a result, the stroke of the plunger 14 can be changed per each cycle of delivery by changing the number of rotations of the motor 53 per cycle of delivery.

INDUSTRIAL APPLICABILITY

The present invention can be applied to products in wide ranges requiring liquid feed under pressure without being limited to delivery and coating.

The invention claimed is:

1. A liquid delivery method for delivering a liquid by reciprocally moving a plunger in a cylinder while a selector valve is shifted in a valve chamber to change over communication of the cylinder and the valve chamber with a channel leading to a liquid tank and communication of the cylinder and the valve chamber with a channel leading to a delivery port from one to the other, the method comprising the steps of:

arranging an opening/closing valve in a channel for communicating the liquid tank and the valve chamber with each other, shifting the selector valve to a first position to establish the communication between the cylinder and the channel leading to the liquid tank and opening the opening/closing valve when a liquid is filled in the cylinder, retracting the plunger in the cylinder thereby drawing the liquid into the cylinder from the liquid tank, shifting the selector valve to a second position to establish the communication between the cylinder and the channel leading to the delivery port and closing the opening/closing valve, and advancing the plunger in the cylinder thereby delivering the liquid through the delivery port, wherein the opening/closing valve is automatically opened and closed by employing a check valve disposed in such orientation that the liquid is allowed to flow from the liquid tank to the valve chamber, but the liquid flow from the valve chamber to the liquid tank is blocked.

2. The liquid delivery method according to claim 1, wherein the selector valve is moved while sliding along an inner wall surface of the valve chamber without coming into tight contact with the inner wall surface of the valve chamber or without causing excessive friction.

3. The liquid delivery method according to claim 1, wherein the selector valve is moved by rotating, in the valve chamber, a selector valve having a first opening formed to position on an axis of valve rotation and a second opening communicated with the first opening.

4. The liquid delivery method according to claim 1, wherein the cylinder is arranged with a fore end of the plunger directed upward.

5. A liquid delivery apparatus comprising:

a cylinder in which a plunger is inserted, a delivery port, a liquid tank, a valve chamber having a first port communicating with the cylinder, a second port communicating with the liquid tank, and a third port communicating with the delivery port, the valve chamber including a selector valve disposed therein, and an opening/closing valve disposed in a channel for communicating the valve chamber and the liquid tank with each other, wherein the opening/closing valve comprises a check valve disposed in such an orientation that the liquid is allowed to flow from the liquid tank to the second port, but the liquid flow from the second port to the liquid tank is blocked, the selector valve is shifted to a first position to establish communication between the cylinder and a channel leading to the liquid tank and the opening/closing valve is opened when a liquid is drawn into the cylinder from the liquid tank by retracting the plunger, and the selector valve is shifted to a second position to establish the communication between the cylinder and a channel leading to the delivery port and the opening/closing valve is closed when the liquid is delivered through the delivery port.

6. The liquid delivery apparatus according to claim 5, wherein the selector valve is moved while sliding along an inner wall surface of the valve chamber without coming into tight contact with the inner wall surface of the valve chamber or without causing excessive friction.

7. The liquid delivery apparatus according to claim 5, wherein the selector valve has a first opening formed to position on an axis of valve rotation and a second opening communicated with the first opening, and the selector valve is rotated in the valve chamber to selectively communicate the first port with the second port or the third port.

8. The liquid delivery apparatus according to claim 5, wherein the cylinder is arranged with a fore end of the plunger directed upward.

9. The liquid delivery method according to claim 1, wherein the selector valve is a slide valve disposed in the valve chamber.

10. The liquid delivery apparatus according to claim 5, wherein the selector valve is a slide valve disposed in the valve chamber.

11. The liquid delivery method according to claim 1, wherein the gap between the selector valve and the valve chamber is set relatively loose to prevent causing excessive friction.

12. The liquid delivery apparatus according to claim 5, wherein the gap between the selector valve and the valve chamber is set relatively loose to prevent causing excessive friction.

13. The liquid delivery method according to claim 1, wherein no opening/closing valve is arranged in the channel between the valve chamber and the delivery port.

14. The liquid delivery apparatus according to claim 5, wherein no opening/closing valve is arranged in the channel between the valve chamber and the delivery port.

* * * * *